US010041205B2

(12) United States Patent
McLoughlin

(10) Patent No.: US 10,041,205 B2
(45) Date of Patent: Aug. 7, 2018

(54) PORTABLE CLOTHES DRYING ASSEMBLIES

(71) Applicant: Loi McLoughlin, Vernon Hills, IL (US)

(72) Inventor: Loi McLoughlin, Vernon Hills, IL (US)

( * ) Notice: Subject to any disclaimer, the term of this patent is extended or adjusted under 35 U.S.C. 154(b) by 522 days.

(21) Appl. No.: 14/671,388

(22) Filed: Mar. 27, 2015

(65) Prior Publication Data

US 2016/0281291 A1 Sep. 29, 2016

(51) Int. Cl.
*F26B 3/00* (2006.01)
*D06F 59/02* (2006.01)
*D06F 58/14* (2006.01)

(52) U.S. Cl.
CPC ..... *D06F 59/02* (2013.01); *D06F 58/14* (2013.01)

(58) Field of Classification Search
CPC ..... D06F 58/12; D06F 58/14; D06F 59/02; F26B 9/06
USPC ..... 34/443, 509, 235, 96, 281
See application file for complete search history.

(56) References Cited

U.S. PATENT DOCUMENTS 4,199,873 A * 4/1980 Hansen ..... D06F 58/14 219/385
5,555,648 A * 9/1996 Griffin ..... D06F 73/00 223/67
5,642,572 A * 7/1997 Manning ..... D06F 5/14 34/621
5,829,162 A * 11/1998 Pace ..... D06F 5/14 34/202
8,813,385 B2 * 8/2014 Blum ..... A45D 20/00 34/101
9,015,955 B2 * 4/2015 Vezina ..... D06F 58/14 211/182
9,072,359 B2 * 7/2015 Agoro ..... A45D 20/46

* cited by examiner

*Primary Examiner* — John McCormack
(74) *Attorney, Agent, or Firm* — Louise S. Heim

(57) ABSTRACT

Portable clothes-drying assemblies are provided to allow travelers to quickly and easily dry articles of clothing. In one preferred embodiment of the invention, an assembly includes a specially configured garment bag from which a conventional hand held hair dryer is suspended. An adapter tube for directing hot air from the hair dryer into the interior of the garment bag is also provided. The adapter tube has a proximal end configured to sealingly engage the nozzle of the hair dryer and a distal end configured to sealingly engage an inlet formed at the bottom of the garment bag. In another preferred embodiment of the invention, the hair dryer is suspended from a horizontal rod, such as a closet rod, from which an article of clothing is also hung. An adapter assembly is also provided. The adapter assembly includes an adapter tube and a plurality of flexible distribution tubes that extend through the adapter tube and are configured to be inserted into the article of clothing. Each of the tubes has an proximal end configured to receive hot air from the hair dryer nozzle, a closed distal end, and an elongated intermediate portion made from either a porous material such as cloth or an apertured non-porous material that allows hot air to pass into the article of clothing.

16 Claims, 2 Drawing Sheets

PORTABLE CLOTHES DRYING ASSEMBLIES

BACKGROUND

Field of the Invention

This invention relates to the field of driers.

More specifically, the invention relates to portable driers for blow-drying articles of clothing.

In a further and more aspect, the invention comprises assemblies for converting hand held hair driers into portable clothes driers.

Background of the Invention

Business and recreational travelers often prefer to "travel light" and bring only a few items of clothing with them when on the road. For instance, an individual may choose to bring along two or three sets of casual clothes for every day use, and a single set of dress clothes for going out on a special occasion. When any one of these articles of clothing gets soiled, the traveler will typically hand wash it and then either hang it out to air-dry or blow it dry with a conventional hand-held hair-dryer. However, air-drying can take several hours, while blow-drying with a conventional hair dryer requires the use of one or both hands, making it very inconvenient for the time-pressed traveler. Accordingly, there exists a need for portable devices allowing quick, hands-free clothes drying.

SUMMARY

Briefly, to achieve the desired objects of the present invention in accordance with the preferred embodiment thereof, assemblies are provided for converting conventional hand-held, blower-type hair driers into hands-free portable clothes driers. An assembly includes a hair dryer with a nozzle, mounting means for mounting the hair dryer in the vicinity of an article of clothing, an adapter for securing to the nozzle of the air dryer to extend the effective length of the nozzle and direct hot air from the nozzle to the clothing, and collection means for concentrating the hot air before it reaches the clothing.

In one preferred embodiment of the invention, the mounting means comprises a g. The dryer is suspendable from the crosspiece by a pair of flexible straps. The adapter means comprises a tubular member having its proximal end securable to the end of the hair dryer nozzle and its distal end engageable with an inlet opening formed at the bottom of the garment bag. The collection means comprises a hot air chamber defined between the bottom wall of the garment bag and an intermediate perforated wall positioned above the bottom wall. A plurality of openings in the intermediate wall allow hot air to pass from the hot air chamber into a clothing compartment surrounding the article of clothing.

In another preferred embodiment of the invention, the mounting means consists of a pair of flexible straps for suspending the dryer from a horizontal rod. The adapter means comprises a tubular member having its proximal end securable to the end of the hair dryer nozzle and its distal end configured to be inserted into an article of clothing suspended from the same horizontal rod as the dryer. A plurality of flexible distributor tubes extend through the tubular member, each distribution tube having a proximal end, a distal end, and an elongated intermediate portion formed of a porous material such as cloth, or a nonporous material having perforations or apertures through which hot air can escape. The proximal ends of the tubes are retained in a retention disk positioned downstream of the proximal end of the adapter means, whereby the collection means comprises a warm air chamber defined between the retention disk and the proximal end of the adapter means.

BRIEF DESCRIPTION OF THE DRAWINGS

The foregoing and more specific objects and advantages of the instant invention will become readily apparent to those skilled in the art from the following detailed description of the preferred embodiments thereof taken in conjunction with the drawings in which.

DETAILED DESCRIPTION OF THE PREFERRED EMBODIMENTS

Figure 1:
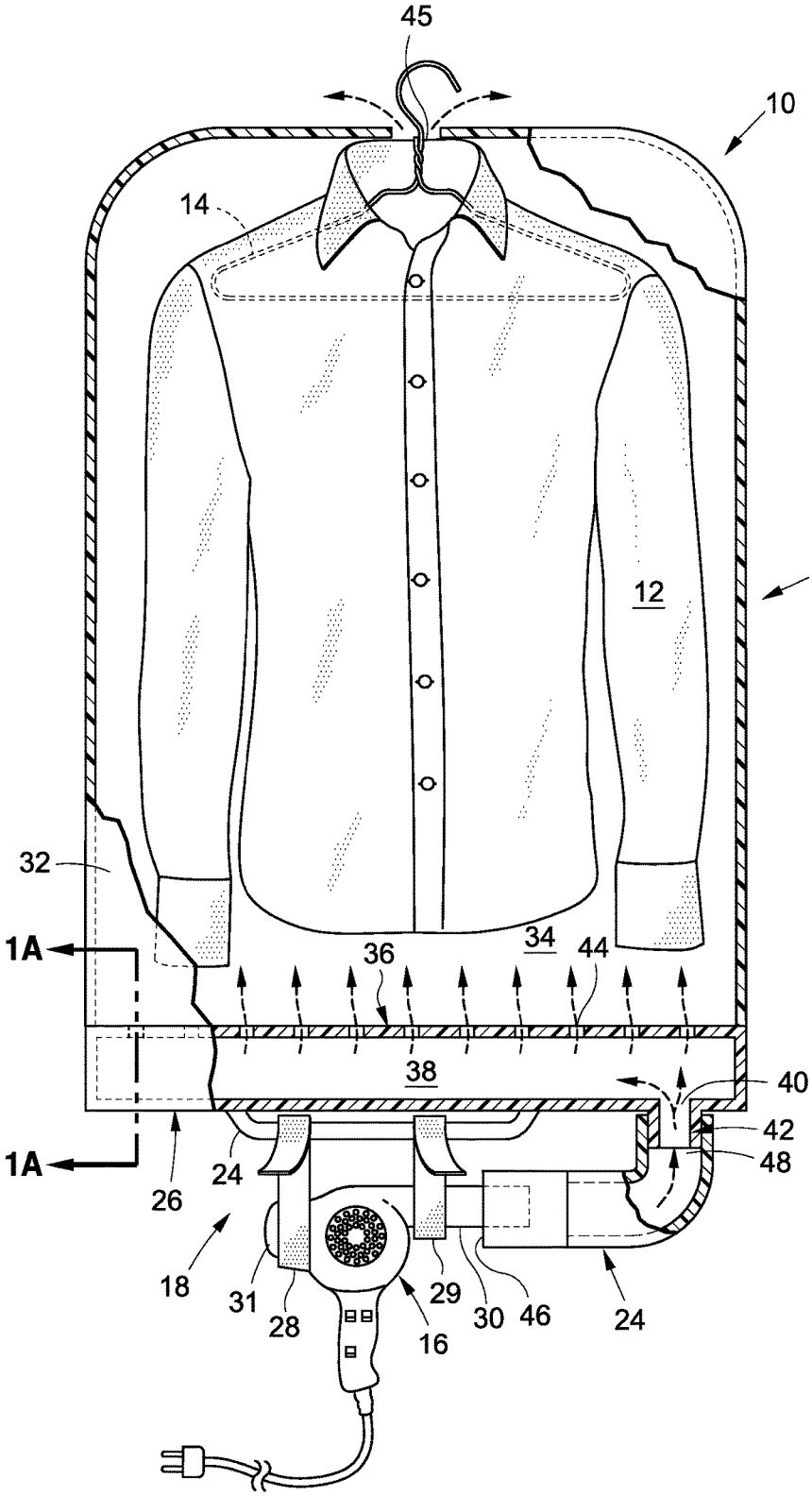
FIG. 1 is a front view, partially broken away, demonstrating the use of a portable clothes drying assembly according to a first preferred embodiment of the invention.

Turning now to the drawings, in which like numerals indicate corresponding elements throughout the several views, attention is first directed to FIG. 1, showing the portable drying assembly of the present invention, indicated in its entirety by the numeral 10, being used to dry a shirt 12 suspended from a conventional clothes hanger 14. The assembly 10 comprises a conventional hand held hair dryer 16, a mounting assembly 18 for securing the hair dryer 16 in a relatively stationery position relative to the shirt, and an adapter tube 20 for directing hot air from the hair dryer 16 to the shirt 12.

More specifically, the mounting assembly 18 comprises a specially configured garment bag 22 having a crosspiece 24 secured to its bottom wall 26, and mounting straps 28, 29 configured to suspend the dryer 16 from the crosspiece. In the illustrated embodiment, the mounting straps are provided in the form of a pair of flexible straps having mating hook and loop type fasteners formed at their opposing ends. One of the straps 28 is looped around the nozzle 30 of the hair dryer 16, and the other strap 29, is looped around the rear portion 31 of the hair dryer, which typically houses the exhaust fan (not shown). However, other arrangements of straps or equivalent fasteners, which will be readily apparent to one of ordinary skill in the art, may be more appropriate for other configurations of hair dryers, and are intended to be included within the scope of this invention.

The garment bag 22, which is formed from a heat-resistant material, comprises a pair of side walls 32 defining a clothing compartment 34. An envelope having a heat resistant exterior wall 36 and a hollow interior defines a hot air chamber 38 above the bottom wall 26 of the garment bag 22. Hot air enters the chamber 38 through an inlet opening 40 surrounded by a downwardly extending neck or attachment flange 42, and passes from the chamber 38 into the clothing compartment 34 via a plurality of vents 44 formed in the exterior wall 36. The hot air then exits the clothing compartment 34 through an outlet opening 45 at the top of the garment bag 22.

Figure 1A:
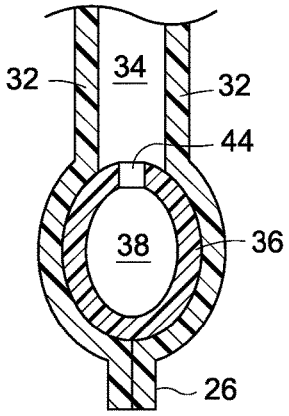
FIG. 1A is a sectional view taken through line A-A of FIG. 1.

Although the exterior wall 36 of the envelope is illustrated in FIG. 1A as being an elliptical cylindrical tube, other configurations can readily be envisioned. For instance, the exterior wall could also consist of a flat strip or sheet of material extending parallel to the bottom wall 32.

The adapter tube 20 is formed of heat-resistant material and includes a proximal end 46 and a distal end 48. The proximal end 46 is configured to sealingly engage or otherwise securely fit over or into the nozzle 30 of the hair dryer 16, while the distal end 48 is configured to sealingly engage with the attachment flange 42 depending from the bottom wall. The tube 20 may be formed from a flexible material allowing it to be easily bent or curved upwardly toward the attachment flange 42, or it may formed from a rigid material, with the distal end 48 extending at a fixed upward curve (at least 90 degrees and less than 180 degrees) with respect to the proximal end 46.

Figure 2:
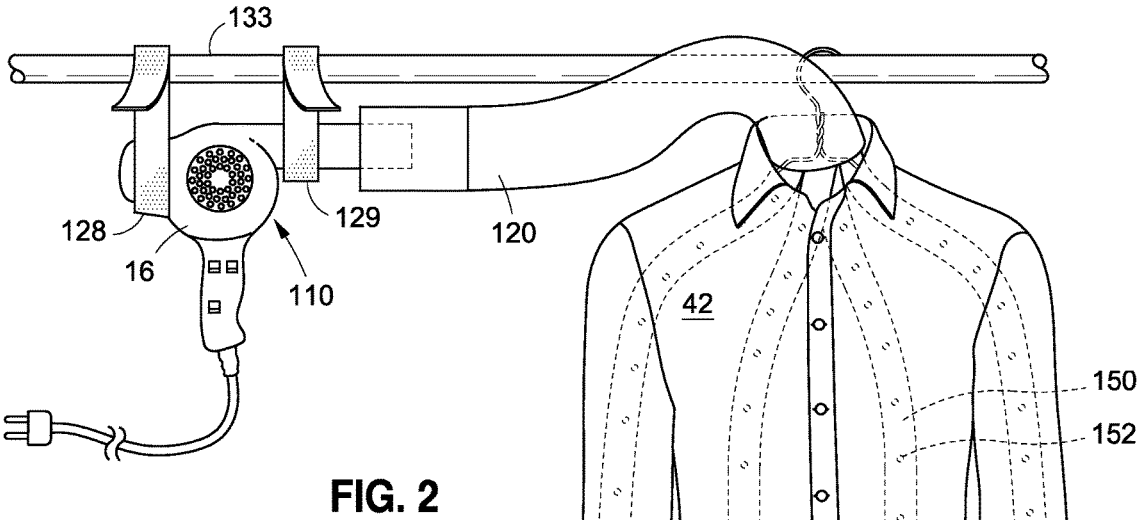
FIG. 2 is a front view, partially broken away, demonstrating the use of a portable clothes drying assembly according to a second preferred embodiment of the invention.
Figure 3:
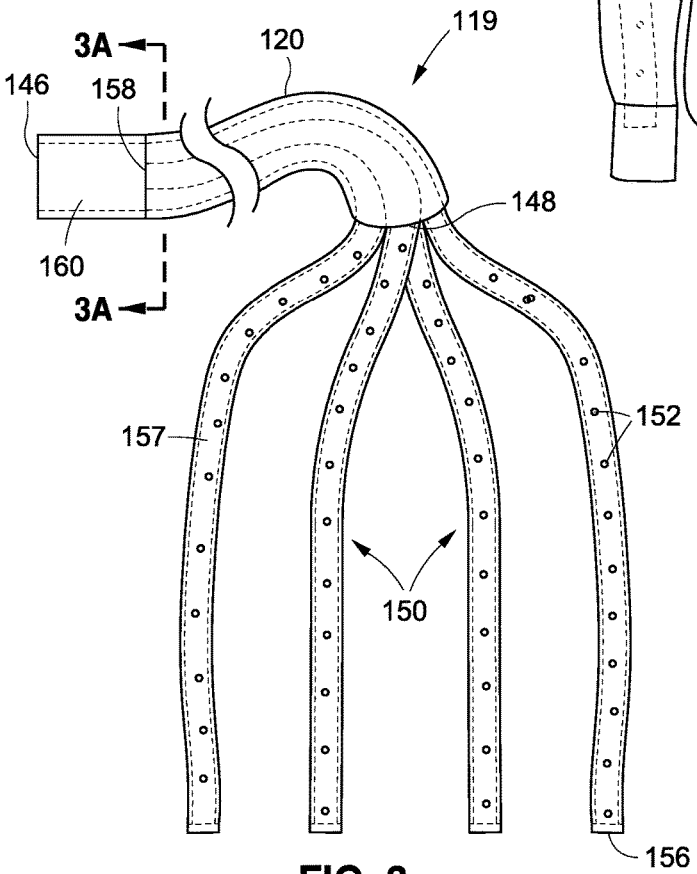
FIG. 3. is a front view showing an adapter assembly according to the embodiment of FIG. 2.
Figure 3A:
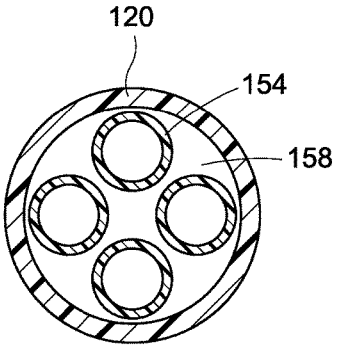
FIG. 3A is a sectional view taken through line A-A of FIG. 3.

An alternate preferred embodiment of the invention is illustrated in FIGS. 2 and 3. In this embodiment, indicated in its entirety by the numeral 110, the garment bag has been eliminated and the mounting means consists solely of flexible straps 128 and 129 for hanging the hair dryer 16 directly from a horizontally extending structure such as a clothing rod 133 in a closet. Furthermore, the adapter tube 20 of the previous embodiment has been replaced by an adapter assembly 119 comprising an adapter tube 120 and a plurality of distributor tubes 150 that extend longitudinally through the adapter tube 120.

Like its counterpart in the previous embodiment, the adapter tube 120 is formed of heat-resistant material and includes a proximal end 146 and a distal end 148. Unlike its counterpart however, the distal end 148 is intended to be free and need not conform to any particular dimensions or geometric configuration. If the tube 120 is formed from a flexible material, it may be bent or curved downwardly into an article of clothing such as a shirt 12 hanging from the same horizontal rod 133 as the dryer 16. Alternatively, if the tube 120 is formed from a rigid material, the distal end 148 should extend at a fixed upward curve at least 90 degrees and less than 180 degrees) with respect to the proximal end 146.

The distributor tubes 150 may be formed of a flexible porous material such as cloth, or a flexible non-porous material such as heat-resistant vinyl having a number of apertures, perforations, or vents 152 formed along its length. Each tube 150 has an open proximal end 154, a closed distal end 156, and an intermediate portion 157 having a length substantially greater than the length of the adapter tube 120. The proximal end 154 of each tube 150 is held in an opening in a retaining disk 158 that is press-fit or otherwise securely retained downstream of the distal end 146 of the adapter tube 120.

The space 160 between the retaining disk and distal end of the adapter tube 120 defines a hot air chamber where air from the dryer 16 collects before passing in concentrated streams through the distributor tubes 150. When the tubes 150 are extended through an article of clothing, as shown in FIG. 2, the hot air escapes through the pores or vents 152, and is distributed throughout article, allowing it to be dried quicky and efficiently.

The mounting and adapter means of both embodiments may be provided in combination with any conventional blower-type hair dryer, or they may be provided separately in the form of conversion kits that the consumer can purchase in order to convert his or her own hair dryer (or a hotel dryer) into a clothes dryer. Given that a very large number of hair dryers are available in a wide variety of sizes and configurations, it is anticipated that minor modifications may be needed in both the mounting means and the adapter tube, in order to conform to the designs of the hair dryers. Such modifications could readily be envisioned and made by those skilled in the art without departing from the spirit of the present invention.

Similarly, although the clothes drying assemblies of the present invention are illustrated in use with a long-sleeved shirt, they may clearly be used, with or without modification, to dry other articles of clothing such as pants, dresses, shirts, and shoes, without departing from the spirit of the invention. Any variations in the basic design that are necessary to accommodate different types of clothing are intended to be included within the scope the invention, which is assessed only by a fair interpretation of the following claims.

Having fully described and disclosed the instant invention and a preferred embodiment thereof in such clear and concise terms as to enable those skilled in the art to understand and practice the same, the invention claimed is:

1. A portable clothes drying assembly, comprising:

a) a hand-held hair dryer having a nozzle;

b) a garment bag configured to house an article of clothing disposed on a hanger suspended from a horizontally extending rod, the garment bag including i) a pair of exterior side walls defining a clothing compartment, ii) a bottom wall having an inlet opening, iii) a hot air chamber defined above the inlet opening, iv) a divider wall separating the hot air chamber from the clothing compartment, and v) at least one vent in the divider wall allowing concentrated streams of air to pass from the hot air chamber to the clothing compartment, and vi) a horizontal crosspiece extending substantially parallel to the bottom wall of the garment bag;

c) an attachment assembly securing the hair dryer to the crosspiece and supporting the hair dryer in a horizontal orientation wherein the nozzle extends substantially parallel to the bottom wall of the garment bag; and d) an adapter tube detachably secured to the nozzle to extend the effective length of the nozzle and to direct hot air from the nozzle into the garment bag, wherein the adapter tube is formed of a rigid, heat-resistant material and includes i) a proximal end sealingly engaging the nozzle of the hair dryer; and ii) a distal end extending at a fixed angle with respect to the proximal end and configured to direct air from the hair dryer upwardly into the inlet opening of the garment bag.

2. The clothes drying assembly according to claim 1, wherein the attachment assembly comprises at least one flexible strap releasably secured around the crosspiece and under the hair dryer to detachably hang the hair dryer from the crosspiece.

3. The clothes drying assembly according to claim 2, wherein:

a) the hair dryer includes a rear portion; and b) the at least one flexible strap includes a first flexible strap releasably extending around the crosspiece and under the nozzle of the hair dryer, and a second flexible strap releasably extending around the crosspiece and under the rear portion of the hair dryer.

4. The clothes drying assembly according to claim 3, wherein each strap includes:

a) a pair of opposed ends, and b) mating elements on each of the opposed ends detachably securing the opposed ends together to form each of the straps into a loop detachably securing the hair dryer to the crosspiece.

5. The clothes drying assembly of claim 1, wherein the fixed angle is approximately 90 degrees.

6. A conversion kit for converting a hand-held hair dryer having a nozzle into a portable clothes dryer, the kit comprising:

a) a garment bag configured to house an article of clothing disposed on a hanger suspended from a horizontally extending rod, the garment bag including
  i) a pair of exterior side walls defining a clothing compartment,
  ii) a bottom wall having an inlet opening,
  iii) a hot air chamber defined above the inlet opening,
  iv) a divider wall separating the hot air chamber from the clothing compartment,
  v) at least one vent in the divider wall allowing concentrated streams of air to pass from the hot air chamber to the clothing compartment, and
  vi) a horizontal crosspiece extending substantially parallel to the bottom wall of the garment bag;

b) an attachment assembly configured to secure the hair dryer to the crosspiece in a horizontal orientation wherein the nozzle extends substantially parallel to the bottom wall of the garment bag; and c) an adapter tube detachably secured to the nozzle to extend the effective length of the nozzle and to direct hot air from the nozzle into the garment bag, wherein the adapter tube is formed of a rigid, heat-resistant material and includes
  i) a proximal end sealingly engaging the nozzle of the hair dryer; and
  ii) a distal end extending at a fixed angle with respect to the proximal end and configured to direct air from the hair dryer upwardly into the inlet opening of the garment bag.

7. The conversion kit according to claim 6, wherein the attachment assembly comprises at least one flexible strap configured to be releasably secured around the crosspiece and under the hair dryer to detachably hang the hair dryer from the crosspiece.

8. The conversion kit according to claim 7, wherein:

a) the hair dryer includes a rear portion; and b) the at least one flexible strap includes
  i) a first flexible strap configured to releasably extend around the crosspiece and under the nozzle of the hair dryer, and
  ii) a second flexible strap configured to releasably extend around the crosspiece and under the rear portion of the hair dryer.

9. The conversion kit according to claim 8, wherein each strap includes a) a pair of opposed ends, and b) mating elements on each of the opposed ends detachably securing the opposed ends together to form each of the straps into a loop detachably securing the hair dryer to the crosspiece.

10. The conversion kit according to claim 6, wherein the fixed angle is approximately 90 degrees.

11. A portable clothes drying assembly configured to dry an article of clothing disposed on a hanger suspended from a horizontally extending rod, comprising:

a) a hand-held hair dryer having a nozzle;

b) an attachment assembly securing the hair dryer to the rod in a horizontal orientation above the article of clothing wherein the nozzle extends substantially parallel to the rod;

c) an adapter tube detachably secured to the nozzle to extend the effective length of the nozzle and to direct hot air from the nozzle downwardly into the article of clothing, the adapter tube including
  i) a proximal end sealingly engaging the nozzle of the hair dryer, and
  ii) a distal end configured to direct air from the hair dryer towards the article of clothing;

d) a plurality of flexible distributor tubes extending through the adapter tube, each of the distributor tubes including
  i) a proximal end configured to receive air from the nozzle of the hair dryer;
  ii) a distal end; and
  iii) a flexible intermediate portion formed of porous material, the intermediate portion extending between the proximal and distal portions and having a length greater than the length of the adapter tube;

wherein the distributor tubes are configured to be inserted into, and extend downwardly through, the article of clothing, allowing hot air from the hair dryer to be distributed throughout.

12. The portable clothes drying assembly according to claim 11, further comprising a heat-resistant planar retention disk disposed in the adapter tube at a location distal to the proximal end of said adapter tube, the retention disk extending entirely across the adapter tube and including a plurality of apertures for retaining the proximal ends of the distributor tubes, the retention disk and the proximal end of said adapter tube defining a collection chamber allowing hot air to accumulate before entering the distributor tubes.

13. The portable clothes drying assembly according to claim 11, wherein the adapter tube is formed of a flexible material allowing the distal end to be bent away from the proximal end.

14. The portable clothes drying assembly according to claim 11, wherein the attachment assembly comprises at least one flexible strap releasably extending around the rod and under the hair dryer to detachably hang the hair dryer from the rod.

15. The portable clothes drying assembly according to claim 14, wherein:

a) the hair dryer includes a rear portion; and b) the at least one flexible strap includes
  a first flexible strap releasably extending around the rod and under the nozzle of the hair dryer, and
  a second flexible strap releasably extending around the rod and under the rear portion of the hair dryer.

16. The portable clothes drying assembly according to claim 15, wherein each strap includes:

a) a pair of opposed ends, and b) mating elements on each of the opposed ends detachably securing the opposed ends together to form each of the straps into a loop detachably securing the hair dryer to the rod.

* * * * *